US007544294B2

(12) United States Patent
Halterman

(10) Patent No.: US 7,544,294 B2
(45) Date of Patent: Jun. 9, 2009

(54) ACTUATED STRAINER FOR BOTTLES

(76) Inventor: C. Todd Halterman, 5003 W. 19th Ave., Kennewick, WA (US) 99338

( * ) Notice: Subject to any disclaimer, the term of this patent is extended or adjusted under 35 U.S.C. 154(b) by 321 days.

(21) Appl. No.: 11/530,798

(22) Filed: Sep. 11, 2006

(65) Prior Publication Data

US 2008/0066486 A1 Mar. 20, 2008

(51) Int. Cl.
*B01D 29/03* (2006.01)
*B01D 33/01* (2006.01)
*B01D 35/02* (2006.01)

(52) U.S. Cl. ..... 210/232; 210/359; 210/470; 210/482; 215/391; 220/694; 206/804

(58) Field of Classification Search ..... 210/232, 210/359, 470, 482; 215/391; 220/694; 206/804
See application file for complete search history.

(56) References Cited

U.S. PATENT DOCUMENTS 3,580,409 A 5/1971 Soboleski
5,456,388 A 10/1995 Honstein et al.
5,868,266 A * 2/1999 Nobakht ..... 220/23.86
6,036,038 A * 3/2000 Lovelace et al. ..... 215/391
6,231,909 B1 5/2001 Levinson

FOREIGN PATENT DOCUMENTS

FR 2752227 A1 * 2/1998

* cited by examiner

*Primary Examiner*—Thomas M Lithgow
(74) *Attorney, Agent, or Firm*—Black Lowe & Graham, PLLC

(57) ABSTRACT

A container includes a vessel having an opening proximate an upper end thereof and a floor proximate a lower end thereof. A threaded shaft secures to the floor and extends along a substantial portion of the height of the vessel. A slider having a threaded portion secures to the shaft. In a preferred embodiment, the slider defines passages allowing fluid to pass through the slider. A grippable member secures to the shaft enabling a user to rotate the shaft and cause the slide to move up in order to lift food items out of fluid within the container.

5 Claims, 3 Drawing Sheets

ACTUATED STRAINER FOR BOTTLES

FIELD OF THE INVENTION

This invention relates generally to food containers, and, more particularly, to containers for foods suspended in water or other fluids.

BACKGROUND OF THE INVENTION

Pickles, olives, and other foods are often packaged in bottles suspended in a large amount of water. It is often inconvenient to retrieve the pickles, for example, from the fluid without using a separate utensil or spilling the water. As the typical consumer uses up the pickles, the amount of fluid relative to pickles becomes large and it is difficult to fish out the last of the remaining pickles. Often, the remaining pickles are thrown out because it is not worth the trouble to retrieve them.

Accordingly, it would be an advancement in the art to provide a simple and effective system and method for storing and dispensing foods suspended in water.

SUMMARY OF THE INVENTION

A container in accordance with an embodiment of the present invention includes a vessel having an opening proximate an upper end thereof and a floor proximate a lower end thereof. A threaded shaft secures to the floor and extends along a substantial portion of the height of the vessel. A slider having a threaded portion secures to the shaft. In a preferred embodiment, the slider defines passages allowing fluid to pass through the slider. A grippable member secures to the shaft enabling a user to rotate the shaft and cause the slide to move up in order to lift food items out of fluid within the container.

In one embodiments the grippable member is located below the floor and the shaft passes through the floor to connect to the grippable member. In another embodiment, the shaft secures to a projection secured to the floor and the grippable member is located near the opening of the vessel.

BRIEF DESCRIPTION OF THE DRAWINGS

Preferred and alternative embodiments of the present invention are described in detail below with reference to the following drawings.

DETAILED DESCRIPTION OF THE PREFERRED EMBODIMENT

Figure 1:
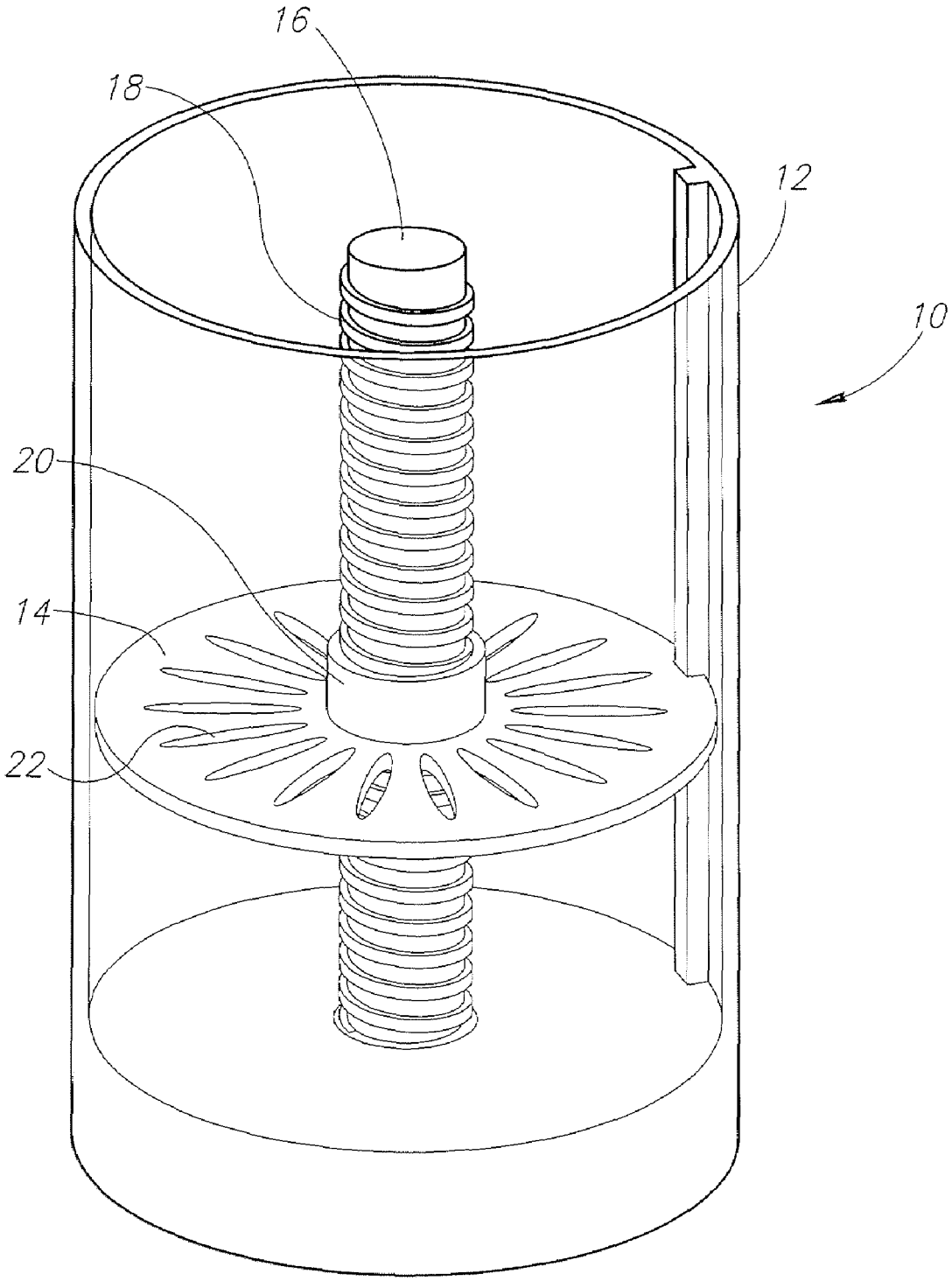
FIG. 1 is an isometric view of a container having a slide in accordance with an embodiment of the present invention.
Figure 2:
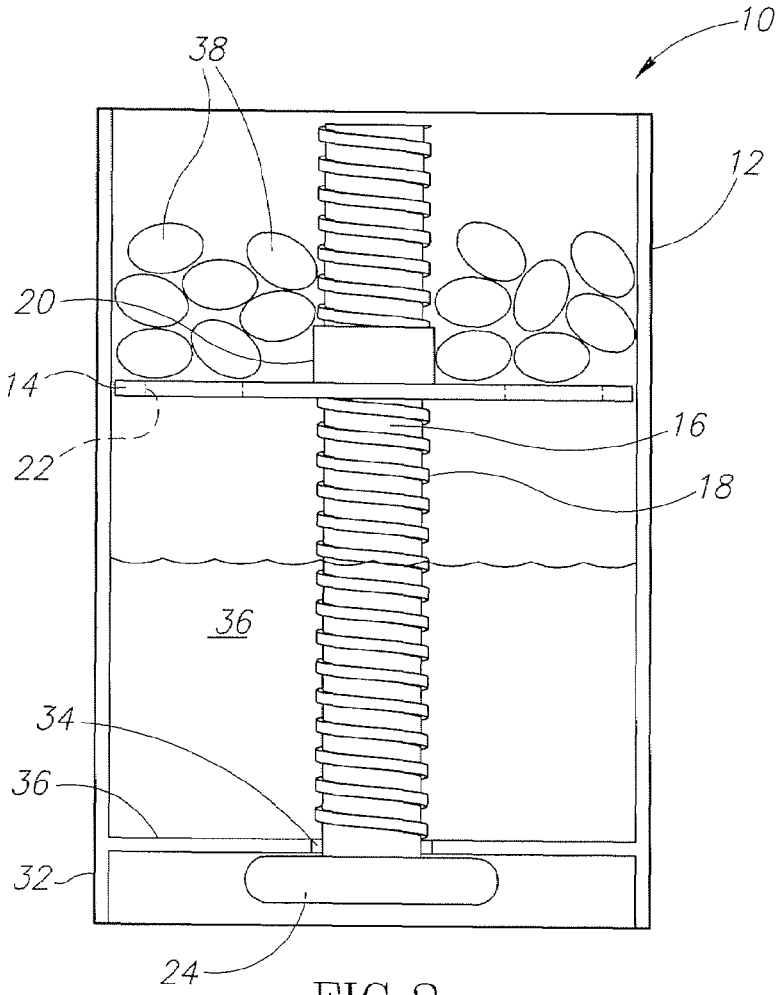
FIG. 2 is a side cross-sectional view of the container of FIG. 1.

Referring to FIGS. 1 and 2, a container 10 includes a vessel 12 having generally cylindrical walls and a wide opening proximate the top thereof. A slider 14 is positioned within the vessel 12. The slider 14 typically extends across substantially the entire area of the vessel 12 and either contacts the inner walls of the vessel 12 or leaves a small gap therebetween. The slider 14 engages a shaft 16 extending vertically through a substantial portion of the height of the vessel. The shaft 16 bears threads 18 and rotatably secures to the vessel 12 near a floor of the vessel 12. A threaded portion 20 is secured to, or formed on, the slider 14 and engages the threads 18 of the shaft 16. In the illustrated embodiment, the threaded portion 20 is embodied as a collar secured to a substantially planar slider 14. In some embodiments, one or more passages 22 allow fluid to pass through the slider 14. In some embodiments, the passages 22 are embodied as holes passing through the slider 14. In other embodiments, the passages 22 are embodied as a gap between the outer perimeter of the slider 14 and the vessel 12.

In some embodiments, the container 10 is used to dispense thick foods such as mayonnaise, peanut butter or the like. In such embodiments, the passage 22 is omitted and the slider 14 typically forms a substantial seal with the walls of the vessel 12 and the threaded shaft 16.

A grippable member 24 secures to the shaft 16 to facilitate gripping by the hand of a user. The user grips the grippable member 24 with the hand to rotate the shaft 16. The engagement of the threads 18 with the threaded portion 20 causes the slider 14 to translate up or down. In some embodiments, a key 26 and keyway 28 ensure that the slider 14 does not rotate with the shaft 16. The key 26 secures to either the vessel 12 or the slider 14 and the keyway 28 secures to the other of the vessel 12 and slider 14. In alternative embodiments, friction between the slider 14 and the vessel 12 or food items resting on the slider 14 serve to resist rotation of the slider 14.

Figure 3:
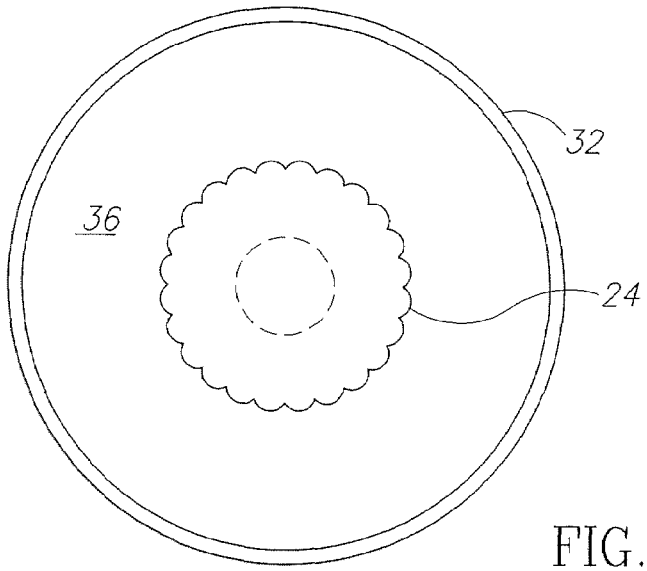
FIG. 3 is bottom view of the container of FIG. 1.

In the embodiment of FIGS. 1 and 2, the grippable member 30 is located beneath the vessel 12. The grippable member 30 may be a substantially straight handle extending across the shaft 16 as shown in FIG. 2. In an alternative embodiment, the grippable member 30 is a round member as shown in FIG. 3. In the embodiment of FIG. 3, the grippable member 30 may be textured to enhance gripping. A lip 32 is also secured vessel 12 near the bottom to enable the vessel 12 to rest stably on a flat surface. A seal 34 secured to the floor 36 of the vessel 12 inhibits leakage of fluid from the vessel 12. The seal 34 is typically formed of a resilient polymer, or the like.

In use, fluid 36 and food items 38 are deposited in the vessel 12. As the food items 38 are removed, the user turns the grippable member 30 to raise the slider and the reaming food items 38. The fluid 36 is allowed to drain through the slider 14 bringing the food items 38 to the top of the vessel 12.

Figure 4:
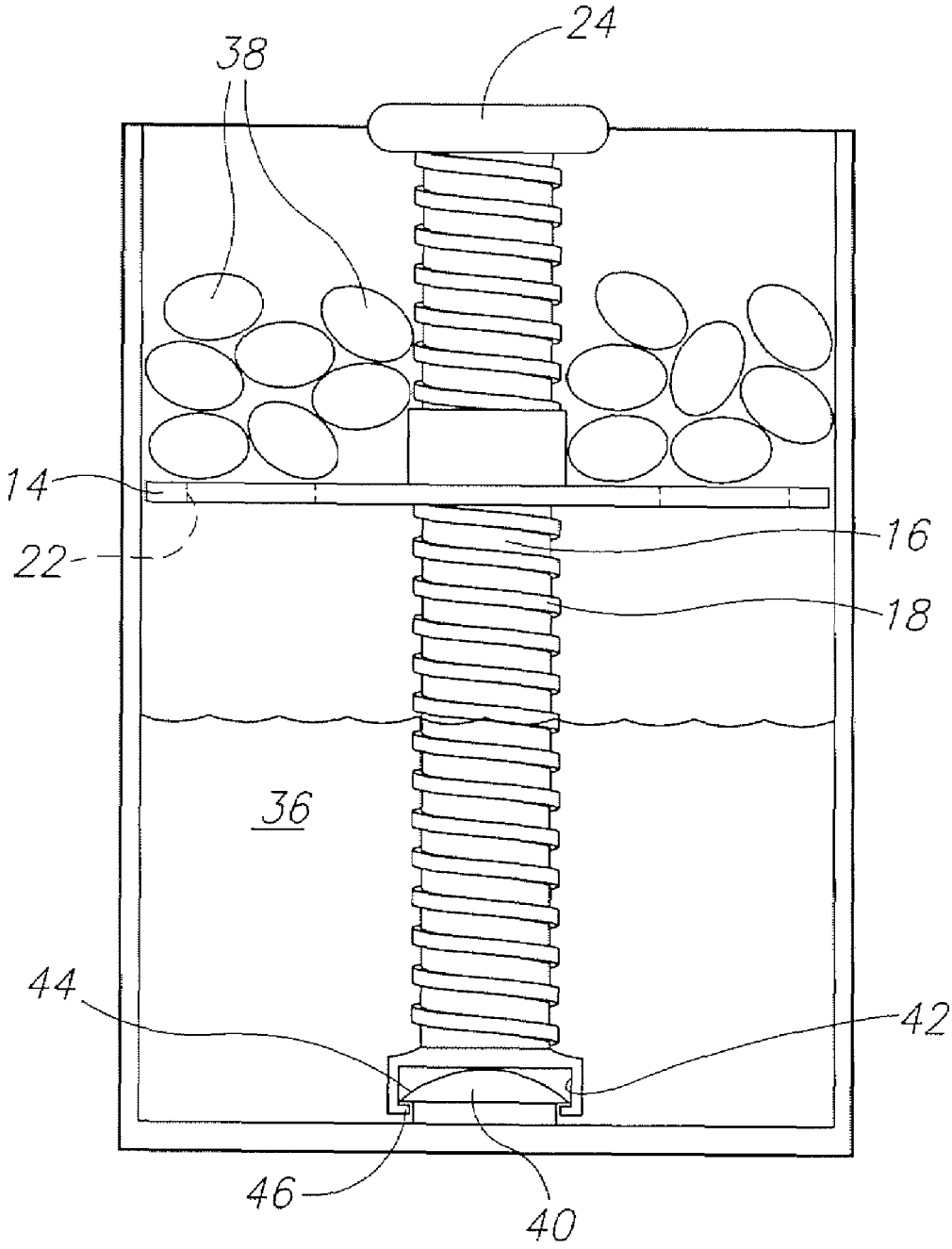
FIG. 4 is a side cross-sectional view of an alternative embodiment of a container in accordance with an embodiment of the present invention.

Referring to FIG. 4, in another embodiment, the grippable member 24 is located near the top of the vessel 12. The shaft 16 secures to the floor 36 without the need of an aperture extending through the floor 36. In one embodiment, a projection 40 secures to the floor 36 and inserts within an aperture 42 in the shaft 16. A lip 44 secured to the projection 40 engages a lip 46 on the shaft 16 to maintain the projection 40 within the aperture 42. The upper surface of the projection 40 has a sloped upper surface to enable the aperture 42 and lip 46 to be forced over the projection 40. In an alternative embodiment, a recess in the floor 36 receives a projection on the shaft 16. The primary advantage of the embodiment of FIG. 3 is that the floor is not pierced, eliminating the possibility of leaks.

In the illustrated embodiment, the vessel 12 has an opening at the upper end. The diameter of the opening is equal in size to the diameter of the vessel 12 along substantial portion of its height. In such embodiments, insertion of the slider 14 through the opening is readily accomplished. In other embodiments, the opening is slightly smaller than the diameter of the vessel 12 along its length. In such embodiments, the slider 14 is typically somewhat flexible to facilitate insertion notwithstanding the slider 14 having a diameter larger than at the opening.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is: claimed are defined as follows:

1. A container comprising:

a vessel having a substantially constant cross section along a substantial portion of the height thereof, an opening proximate an upper end thereof, and a floor proximate a lower end thereof;

a shaft rotatably secured to the floor and bearing a helical path and a grippable member secured to the shaft; and a slider secured to the shaft engaging the helical path positioned between the upper and lower ends, the slider defining a plurality of passages extending therethrough; wherein the shaft extends through the floor and wherein the grippable member is secured below the floor.

2. The container of claim 1, further comprising seal circumscribing the shaft between the shaft and the floor.

3. The container of claim 1, wherein the vessel is at least partially filled with a fluid and solid comestible items within the fluid.

4. A method for dispensing comestible items comprising:

providing a substantially cylindrical vessel having an opening proximate an upper end thereof and a floor proximate a lower end thereof;

providing a shaft rotatably secured to the floor and bearing a helical path;

providing a slider secured to the shaft engaging the helical path positioned between the upper and lower ends, the slider defining at least one fluid passage extending therethrough;

depositing fluid and solid comestible items in the vessel above the slider, the passages prohibiting passage of a substantial number of the comestible items therethrough;

and rotating the shaft to move the slider towards the upper end wherein a grippable member is secured to the shaft and wherein rotating the shaft comprises manually applying a rotational force to the grippable member; and wherein the shaft extends through the floor and wherein the grippable member si secured below the floor.

5. The method of claim 4, wherein a seal circumscribes the shaft between the shaft and the floor.

* * * * *

UNITED STATES PATENT AND TRADEMARK OFFICE

CERTIFICATE OF CORRECTION

PATENT NO. : 7,544,294 B2
APPLICATION NO. : 11/530798
DATED : June 9, 2009
INVENTOR(S) : C. Todd Halterman It is certified that error appears in the above-identified patent and that said Letters Patent is hereby corrected as shown below:

In Column 4, Claim 4, Line 20 the word “si” should be “is”

Signed and Sealed this

Fourteenth Day of July, 2009

John Doll

JOHN DOLL
*Acting Director of the United States Patent and Trademark Office*